US006152972A

United States Patent [19]

Shustorovich et al.

[11] Patent Number: 6,152,972

[45] **Date of Patent: *Nov. 28, 2000**

[54] GASOLINE ADDITIVES FOR CATALYTIC CONTROL OF EMISSIONS FROM COMBUSTION ENGINES

[75] Inventors: Alexander Shustorovich; Eugene Shustorovich, both of Pittsford, N.Y.; Richard Montano, Vienna, Va.; Konstantin Solntsev, Moscow, U.S.S.R.; Yuri Buslaev, Moscow, U.S.S.R.; VEniamin Kalner, Moscow, U.S.S.R.; Nikolai Moiseev, Moscow, U.S.S.R.; Aleksandr Bragin, Moscow, U.S.S.R.

[73] Assignee: Blue Planet Technologies Co., L.P., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/038,426

[22] Filed: Mar. 29, 1993

[51] Int. Cl.[7] ..... C10L 1/12

[52] U.S. Cl. ..... 44/354; 44/550

[58] Field of Search ..... 44/354, 550

[56] References Cited

U.S. PATENT DOCUMENTS

| | | | |
|---|---|---|---|
| 1,989,113 | 1/1935 | Rector . | |
| 2,086,775 | 7/1937 | Lyons et al. . | |
| 2,151,432 | 3/1939 | Lyons et al. . | |
| 2,194,186 | 3/1940 | Pier et al. . | |
| 2,375,236 | 5/1945 | Miller et al. . | |
| 2,434,578 | 1/1948 | Miller et al. . | |
| 2,712,351 | 7/1955 | Roth et al. . | |
| 2,800,172 | 7/1957 | Romer et al. . | |
| 2,946,325 | 1/1960 | Gentile . | |
| 3,211,534 | 10/1965 | Ridgway . | |
| 3,348,932 | 10/1967 | Kukin . | |
| 3,370,419 | 2/1968 | Ketzer . | |
| 3,450,116 | 6/1969 | Knight et al. . | |
| 3,537,434 | 11/1970 | Herpin . | |
| 3,716,040 | 2/1973 | Herpin . | |
| 3,746,498 | 7/1973 | Stengel . | |
| 3,773,894 | 11/1973 | Bernstein et al. . | |
| 3,800,532 | 4/1974 | Schischkow . | |
| 3,856,901 | 12/1974 | Neumann et al. . | |
| 3,862,819 | 1/1975 | Wentworth . | |
| 3,875,922 | 4/1975 | Kirmss . | |
| 3,910,850 | 10/1975 | Turner . | |
| 3,929,118 | 12/1975 | Leong . | |
| 3,953,369 | 4/1976 | Ohara et al. . | |
| 3,959,183 | 5/1976 | Gospodar . | |
| 3,978,193 | 8/1976 | Fedor et al. . | |
| 3,979,185 | 9/1976 | Stevenson . | |
| 3,992,321 | 11/1976 | Van Thillo et al. | 252/429 |
| 3,993,596 | 11/1976 | Andre et al. | 252/448 |
| 4,016,837 | 4/1977 | Wentworth et al. . | |
| 4,024,079 | 5/1977 | Okuyama et al. . | |
| 4,048,098 | 9/1977 | Koberstein et al. . | |
| 4,064,037 | 12/1977 | Graven et al. . | |
| 4,064,039 | 12/1977 | Penick . | |
| 4,090,838 | 5/1978 | Schena . | |
| 4,118,199 | 10/1978 | Volker et al. . | |
| 4,118,339 | 10/1978 | Latos . | |
| 4,170,960 | 10/1979 | Germack et al. . | |
| 4,188,309 | 2/1980 | Volker et al. . | |
| 4,197,272 | 4/1980 | Tighe . | |
| 4,203,895 | 5/1980 | Parcell et al. . | |
| 4,214,615 | 7/1980 | Boyer . | |
| 4,218,422 | 8/1980 | Schock et al. . | |
| 4,255,173 | 3/1981 | Mayer et al. . | |
| 4,276,152 | 6/1981 | McHale et al. . | |
| 4,295,816 | 10/1981 | Robinson . | |
| 4,317,918 | 3/1982 | Takano et al. . | |
| 4,362,130 | 12/1982 | Robinson . | |
| 4,382,017 | 5/1983 | Robinson . | |
| 4,397,772 | 8/1983 | Noakes et al. . | |
| 4,410,467 | 10/1983 | Wentworth . | |
| 4,419,967 | 12/1983 | Protacio et al. . | |
| 4,425,305 | 1/1984 | Kawata et al. . | |
| 4,475,483 | 10/1984 | Robinson . | |
| 4,476,339 | 10/1984 | Reinhard et al. . | |
| 4,517,926 | 5/1985 | Reinhard | 44/354 |
| 4,542,226 | 9/1985 | Eddy et al. . | |
| 4,631,076 | 12/1986 | Kurihara . | |
| 4,646,516 | 3/1987 | Bostock . | |
| 4,665,690 | 5/1987 | Nomoto et al. . | |
| 4,752,302 | 6/1988 | Bowers et al. . | |
| 4,757,045 | 7/1988 | Turner et al. . | |
| 4,787,969 | 11/1988 | Braid | 208/139 |
| 4,842,617 | 6/1989 | Kukin . | |
| 4,863,889 | 9/1989 | Passaretti-Miscia . | |

(List continued on next page.)

FOREIGN PATENT DOCUMENTS

| | | |
|---|---|---|
| 942055 | 11/1963 | United Kingdom . |
| WO 91/01361 | 2/1991 | WIPO . |
| WO 93/16800 | 9/1993 | WIPO . |
| WO 93/21286 | 10/1993 | WIPO . |
| WO 94/22577 | 10/1994 | WIPO . |

OTHER PUBLICATIONS

Grant, Hackl's Chemical Dictionary, 4th. Ed., McGraw–Hill Book Company, 1969, pp. 581,529.

English Abstract of DE 2500638A 76–07–15. Brantl, V.

*Primary Examiner*—Margaret Medley

*Attorney, Agent, or Firm*—Kenyon & Kenyon

[57] ABSTRACT

Catalytic metal additives that directly dissolve in gasoline in concentrations providing efficient and economical three-way catalysis of exhaust gases from internal combustion engines. The additives are compounds of noble (e.g., Pt, Pd, Au and Rh) or non-noble (e.g., Re) metals. The preferred compounds have polar metal ligand bonds, preferably with inorganic ligands such as halogens, oxygen, etc., and/or salts with highly ionic (polarizable) cations such as of alkali metals. The preferred additive is a combination of $X_2PtCl_6$, $RhCl_3$ and $XReO_4$, where X=K, Rh or Cs. A combination of these finely ground materials is fabricated into a briquette or filter which is deposited in the gas tank or placed in a gas line. The catalytic metals are carried by the exhaust gases through the exhaust system where they are deposited on surfaces of the system to convert toxic emissions. In this way, the invention allows for the delivery of efficient gasoline additives without the use of solvents or extraneous agents.

4 Claims, No Drawings

U.S. PATENT DOCUMENTS

| | | | |
|---|---|---|---|
| 4,868,148 | 9/1989 | Henk . | |
| 4,891,050 | 1/1990 | Bowers et al. . | |
| 4,892,562 | 1/1990 | Bowers et al. . | |
| 4,919,903 | 4/1990 | Gandhi et al. . | |
| 4,939,113 | 7/1990 | Tauster et al. . | |
| 5,013,703 | 5/1991 | Staniulis et al. | 502/261 |
| 5,073,532 | 12/1991 | Domesle . | |
| 5,094,821 | 3/1992 | Hitachi et al. . | |
| 5,140,810 | 8/1992 | Kuroda . | |
| 5,266,082 | 11/1993 | Sanders | 44/354 |
| 5,322,671 | 6/1994 | Shustorovich et al. | 422/176 |
| 5,387,569 | 2/1995 | Shustorovich et al. | 502/162 |

GASOLINE ADDITIVES FOR CATALYTIC CONTROL OF EMISSIONS FROM COMBUSTION ENGINES

FIELD OF THE INVENTION

The invention relates to materials which function in the catalytic control of emissions from internal combustion engines, and more particularly to gasoline additives for the catalytic control of such emissions.

BACKGROUND OF THE INVENTION

There has long been a need to employ catalysts in reactions such as simultaneous oxidation of carbon monoxide and unburned hydrocarbons, and the reduction of nitrogen oxides, NOx, (three-way catalysis) which are emitted from automotive engines and the like. The role of catalysts, particularly three-way catalysts, in automotive emission control has been widely studied in the art. For example, Taylor, "Automobile Catalytic Converter", *Catalysis, Science and Technology,* pp. 119–67 (Anderson et al. eds. 1984), describes emission control technology, composition of three-way catalysts, and catalytic supports.

Conventional systems for converting automotive exhaust gases employ a pre-fabricated supported catalyst, typically a solid stratum of catalyst material, such as honeycombed ceramic structures, which are placed in the exhaust section of the automobile. As the emissions pass through the solid, the catalytic metal present on the strata aids in conversion of CO, NOx and unburned hydrocarbons to $CO_2$, $N_2$ and $H_2O$. However, the solid strata-type catalytic converter is eventually expended and require removal and replacement in the exhaust portion of the engine. Moreover, structures such as a honeycomb support are complex and relatively expensive to manufacture. State of the art systems capable of carrying out three-way catalysis include those having supported noble metals such as rhodium and platinum, with rhodium being a preferred catalyst for the reaction:

$$NO+CO \rightarrow \tfrac{1}{2} N_2+CO_2$$

Platinum is the preferred catalyst for oxidation of CO and unburned hydrocarbons.

The noble metals, particularly rhodium, are expensive and in limited supply. This situation is exacerbated by the fact that current usage of rhodium (Rh) in three-way catalysis exceeds the mine ratio of Rh/Pt. Thus, reduction of noble metal usage is necessary for three-way catalysis processes. Therefore, it is desirable to develop alternative approaches to emission control.

In particular, there is a need for alternative economical methods of converting automotive emissions not utilizing conventional non-regenerable solid catalytic material-containing supports in the exhaust system of an automobile.

In an attempt to meet this need, attempts have been made to develop ways to improve fuel combustion and/or to abate the exhaust gases. For example, U.S. Pat. No. 4,891,050 describes gasoline additives comprising platinum group metal compounds which are said to improve operating efficiency of internal combustion engines, in terms of power output per unit of fuel burned, and which are said to reduce the emissions of particulates and noxious gases, such as hydrocarbons and carbon monoxide. Reduction of NOx is also referred to in the reference, but is not supported by any data disclosed in the reference. The disclosed catalytic metal compounds are initially dissolved in an organic solvent miscible in gasoline. All tested compounds in the reference are organometallic compounds containing ligands with unsaturated C—C bonds. The reference does not appear to teach or suggest any catalytic effect occurring outside the combustion chamber.

U.S. Pat. Nos. 4,295,816, 4,382,017 and 4,475,483 describe catalyst solutions and delivery systems for improving the efficiency of combustion chambers. The catalyst solutions described in U.S. Pat. No. 4,382,017 comprise a single metal catalyst compound, $H_2PtCl_6.6H_2O$; a chloride compound such as HCl, LiCl, or NaCl; an antifreeze compound such as ethylene glycol; and approximately 50 percent water by volume. The chloride is a blocking agent which prevents precipitation and destruction of the platinum compound which, it is said, would otherwise occur by use of the antifreeze compound. The solutions are not taught or suggested for use in aiding conversion of automotive emissions, require the chloride "blocking agent," and contain undesirably high levels of water.

U.S. Pat. No. 4,295,816 describes a catalyst delivery system including a single platinum group metal catalyst in water. A layer of oil containing a manganese catalyst is provided on top of the surface of the water. Air is bubbled through the water and is said to meter minute amounts of catalyst to a combustion system, where the catalyst is consumed in the combustion reaction. The patent does not teach or suggest that the solution could be used for deposition onto a surface within the exhaust system of an automobile. The patent does not teach or suggest conversion of emissions from combustion chambers.

U.S. Pat. No. 4,475,483 describes a catalyst delivery system similar to that described in U.S. Pat. No. 4,295,816, with a single rhenium metal catalyst used in place of a platinum group metal catalyst in the water. The patent further describes that an antifreeze agent such as a glycol, dissolves the water along with the catalyst. The patent teaches that if an antifreeze agent is employed, a blocking agent such as NaCl, HCl, or LiCl must be employed to prevent precipitation of the catalyst. The patent does not teach or suggest conversion of emissions from a combustion chamber.

Thus, it can be seen that these known systems involve the use of catalytic solutions or suspensions which are delivered directly to the fuel or are disposed in the combustion air stream. However, there are disadvantages associated with the use of catalytic solutions. First, the solutions themselves may be detrimental to the combustion process or the emission abatement process. Furthermore, the cost of preparing the solutions represents an expense over and above the cost of a conventional solid catalyst and support. For example, in accordance with U.S. Pat. No. 4,382,017 the catalytic solution includes a blocking agent consisting of HCl and LiCl, which are highly corrosive substances. This patent further describes a solution of ethylene glycol and water as the solvent in which to dissolve the metals, thereby wasting costly glycol and introducing an inhibitor (i.e., water) to the combustion environment.

In the prior art, it has not been possible to effectively deliver catalytic additives directly to fuels without solvents or other extraneous agents.

OBJECTS AND SUMMARY OF THE INVENTION

It is an object of the invention to eliminate the need for the use of relatively expensive and/or detrimental solvents and other extraneous agents in catalytic additives by providing catalytic metal compounds which may be added directly to gasoline and which dissolve in the gasoline to yield metal concentrations that provide for the efficient and economical three-way catalysis of exhaust gases.

A further object of the invention is to attain self-regulation of the directly dissolved catalytic compounds by utilizing metal compounds which reach optimal concentrations quickly and remain at optimal levels for a practical length of time.

Yet another object of the invention is to provide catalytic additives for gasoline which will impart catalytic metals into the exhaust gases which, in turn, will deposit the metals onto exhaust system surfaces by gas phase deposition.

These and other objects are accomplished by the present invention which provides a catalytic metal compound additive which may be directly dissolved in gasoline. The metals which may be used in the compounds include both noble precious metals, preferably platinum (Pt), palladium (Pd), gold (Au), and rhodium (Rh), and non-noble metals, preferably rhenium (Re). The metal compounds have polar metal-ligand bonds, preferably formed by purely inorganic ligands such as halogens, oxygen, etc., and preferably salts with highly ionic (polarizable) cations such as those of the alkali (Group 1A) metals. The preferred compounds of platinum are alkali salts of platinum hydrochloric acid $X_2PtCl_6$, where X=potassium (K), rubidium (Rb), or cesium (Cs). The preferred compound of rhodium is rhodium trichloride tetrahydrate $RhCl_3.4H_2O$. The preferred compounds of rhenium are perrhenates such as XReO, where X=K, Rb, or Cs.

For the precious metals Pt and Rh, the optimal concentrations in gasoline are about 0.01 to 1.0 mg/l. Where both a Pt and a Rh compound are included in the additive, the preferred weight ratio of Pt metal to Rh metal is from 5:1 to 10:1. For the non-noble metal Re, the preferred concentration is higher than that of the total of the precious metals by an order of magnitude.

The additive may comprise noble metal catalysts, each directly soluble in gasoline in a concentration of about 0.01 to about 10 mg/l, and non-noble metal catalysts, each directly soluble in gasoline in a concentration of about 10 to about 100 mg/l.

The self regulation of optimal concentrations of Pt, Rh and Re is determined by the proper dynamics of dissolution of the metal compounds. These dynamics depend on a number of factors both intrinsic, such as the equilibrium concentrations of the metal compounds (individually and collectively), and extrinsic, such as the surface contact area of the additive with the gasoline. The latter may be controlled by various means, preferably by forming a briquette or filter from mixtures or solid solutions of finely ground catalytic metal compounds. A shell for the briquette or filter may be made from any material allowing the catalytic compounds to dissolve in the gasoline, particularly a filter type paper. The briquette or filter may be deposited in a gasoline reservoir for the engine or placed across a gasoline flow line.

DETAILED DESCRIPTION OF THE PREFERRED EMBODIMENTS

Metals which may be used in the catalytic compounds of the invention include non-noble metals, including rhenium, and noble metals, including platinum, palladium, gold and rhodium. It has been found that the catalytic activity of metals deposited from exhaust gases appears to be rather insensitive to the particular compound of the catalytic metal used. Therefore, in accordance with the invention, one can use any of the compounds of said metals that provides the concentrations effective for catalysis, preferably three-way catalysis, which includes the oxidation of carbon monoxide (CO), the oxidation of unburned hydrocarbons, and the reduction of nitrogen oxides (NOx) to $CO_2$, $H_2O$ and $N_2$.

The economic guidelines for the consumption of precious metals such as Pt and Rh may be established from comparisons with conventional catalytic converters. Typically, for example, a catalytic converter serving for 50,000 miles contains 1.5 to 3.5 grams of Pt and approximately 0.3 grams of Rh. Using an average fuel efficiency of 25 to 30 miles per gallon, one finds that the economic (i.e., maximum) metal concentrations which would achieve effective catalysis are of the order of $\theta_{Pt}$=0.5 to 1.0 milligrams per liter (mg/l) of Pt, and $\theta_{Rh}$=0.05 to 0.10 mg/l of Rh. The weight ratio of Pt to Rh, where both metals are used to achieve catalysis, is 5–10 to 1. Preferably, both of these guidelines are taken into consideration in the selection of the metal compounds to be used for the additives of the invention.

The solubility of the metal compounds of the invention in gasoline is an important factor in achieving the optimum metal concentrations set forth above. In accordance with the invention, the preferred additive compounds have a solubility in gasoline such that when they are added in excess quantities to the gasoline, the metal concentration imparted to the gasoline falls within the optimal concentration ranges set forth above. In this way, when the catalytic metal compounds are added in amounts greater than those which are soluble in the certain volume of gasoline provided, they will dissolve in the gasoline only to the extent of providing the desired optimum concentrations as gasoline is expended and replenished. The excess catalytic additive in the gasoline will not dissolve until the metal concentrations in the gasoline falls below the maximum solubility of the compounds. With additives of the invention, the catalyst metal compounds preferably are directly soluble in gasoline. That is, the compounds preferably do not require employment of solvents and other extraneous agents in catalytic additives, which can be relatively expensive and/or detrimental.

As can be seen from the examples below, suitable catalytic metal compounds can have polar metal—ligand bonds. Such bonds are preferably formed by purely inorganic ligands such as the halogens and oxygen, among others known in the art. Preferred additives are salts of those polar metal—ligand compounds with highly ionic (polarizable) cations, preferably of the alkali (Group IA) metals.

Where platinum is used as a catalytic metal, suitable Pt(II), Pt(III) and Pt(IV) compounds may be employed. The preferred platinum compounds are alkali salts of platinum (IV) hydrochloric acid, $X_2PtCl_6$, where X is potassium (K), rubidium (Rb) or cesium (Cs).

Where rhodium is used as a catalytic metal, suitable Rh(II) and Rh(III) compounds may be employed. The preferred compound is rhodium (III) trichloride tetrahydrate, $RhCl_3.4H_2O$.

Where rhenium is used as a catalytic metal, the preferred compounds are perrhenates such as $XReO_4$, where X=K, Rb or Cs.

It has been found that for such small concentrations of Pt and Rh, as set forth above, there may be distinct solubility variations depending on the gasoline composition. The following procedure can be used to make the analytical results more definite and reproducible.

Samples of lead free gasoline with octane ratings between 76 and 93 may be distilled and the fractions boiling above 160° C. discarded. The lower boiling fractions typically have the following temperature distribution: 50 to 70° C., 1%; 70 to 100° C., 4%; 100 to 140° C., 60%; 140 to 160° C., 15% (in total, 80% of the original sample). Metal compounds in amounts between 0.2 and 1.0 grams may be tested by placing them in a closed flask containing 50 to 100 ml of gasoline prepared according to the above-mentioned procedure. The process of dissolution of the metal compound may be investigated both with and without a magnetic mixer in the flask. Samples of the gasoline solution are taken regularly and evaporated at room temperature. Dry sediment is typically deposited as a barely visible film on the bottom the flask. The sediment is dissolved in diglyme and the product may be analyzed by known atom-adsorption methods. For the precious metals Pt and Rh, the above-described techniques allow one to determine the metal concentrations with an accuracy of $\leqq 0.01$ mg/l. For Re the technique is less sensitive, with the threshold being 100 mg/l.

Organometallic compounds of transition and/or noble metals, particularly of Pt and Rh, are readily soluble in gasoline if they have hydrocarbon ligands with unsaturated C═C bonds, particularly of an olefinic or aromatic nature (cf. an extensive discussion in U.S. Pat. No. 4,891,050). While not intending to be bound by any theory, the most likely reason for this solubility is that gasolines are mixtures of various basically non-polar hydrocarbons. Therefore, in order to obtain and maintain low metal concentrations, such as those set forth above ($\theta$=0.01 to 10.0 mg/l), the present invention employs transition metal compounds with rather polar bonds, preferably formed by purely inorganic ligands such as halogens, oxygen, etc., and preferably salts with highly ionic (polarizable) cations such as those of the alkali (Group 1A) metals.

Three-way catalysis can be achieved by a combination of a Pt compound, a Rh compound and a Re compound in accordance with the invention. The compounds are preferably finely ground and fabricated into a briquette (e.g., by compacting) which is deposited in the gasoline reservoir for the engine. Alternatively, the finely ground mixture of compounds may be formed into a filter for placement in a gas line. In either case, the catalytic metals will become entrained in the exhaust fumes from the combustion engine and they will be deposited by gas phase deposition along surfaces in a catalyst collector where they will function in a known manner.

The catalyst collector is located downstream of the combustion chamber. The collector receives the catalyst and serves as a reaction vessel for conversion of automotive emissions to $CO_2$, $N_2$, and $H_2O$. The catalyst collector is any surface capable of retaining the catalyst and making the catalyst sufficiently available for reaction with automotive emissions which flow past the collector. The collector can be any section of the exhaust system. While it is preferred that the collector is a muffler or muffler-like system, the collector can also be a section of the tailpipe of an automotive system. In this embodiment, the catalyst is deposited on the surface of the tailpipe and acts as a reaction site for the emissions passing through the tailpipe.

Preferably, the collector is a muffler or muffler-like system having a series of trays and/or baffles and/or a packed bed, with the inclusion of a packed bed particularly preferred. A copending and commonly owned application Ser. No. 07/840,860 filed on Feb. 25, 1992 and a copending and commonly owned application, Ser. No. 08/038,435, filed on Mar. 29, 1993, entitled "Catalytic Vessel For Receiving Metal Catalysts by Deposition from the Gas Phase" contain further details and embodiments of suitable collectors for use in the method of the present invention, and the disclosure of those applications is incorporated herein by reference. The surface of the muffler should allow the catalyst to be retained in the collector sufficiently to convert emissions passing through the collector. It is preferred that the muffler surface either be made from a solid material having a structure capable of retaining the metals from the catalytic solution, or contain cracks or pores on its surface capable of retaining the catalytic metal. Suitable muffler surface materials can include steel, iron, ceramics, and thermosetting polymers, with low carbon steel being particularly preferred. Low carbon steel refers to steel having a carbon content less than about 0.5 percent by weight. Other suitable materials are various stainless steels, such as stainless steels bearing the ASME designations 409L and 410L. Stainless steels can be particularly suitable for applications where resistance to thermal stresses over time is desired. Preferably, the catalytic metals are retained on a highly oxidized steel surface ($Fe_xO_y$).

In a particularly preferred embodiment, the muffler further contains an additional material, such as a packing material, capable of retaining the metal catalyst. It has been found that iron-based materials, including steels, particularly low carbon steel, in the form of ribbons, sheets, shavings and/or plates, including flat or corrugated materials, are especially useful in the practice of the invention. The low carbon steel ribbons or sheets preferably are acid washed and packed into the muffler. As the metal catalyst is carried into the muffler, the catalyst is deposited on the steel packing. Emissions passing through the muffler from the combustion chamber can then contact the metal catalyst and be converted to $N_2$, $CO_2$ and $H_2O$. CO and unburned hydrocarbons are oxidized and $NO_x$ is reduced on the catalytic metal sites. Each of these components is adsorbed onto the metal site, and after conversion, the reaction products are desorbed, making the site available for further conversion. The catalysis reaction preferably is a three-way catalysis: oxidizing CO, oxidizing unburned hydrocarbons, and reducing $NO_x$. Optionally, an additional oxidation catalyst can be employed to increase the conversion of CO and unburned hydrocarbons emitted from the combustion chamber.

Preferably, the additives of the invention may also be used with the catalytic system described in commonly owned copending application Ser. No. 07/841,357 filed on Feb. 25, 1992, the disclosure of which is incorporated herein by reference.

Since it will take at least some time for the first traces of metals to be deposited in the exhaust system, in the case of a new automobile or exhaust system, it may be desirable to pretreat the internal surfaces of the muffler or tailpipe with a catalytic solution, such as a solution as described in the aforesaid application Ser. No. 07/841,357. In this way, catalytic conversion may begin from the first moment that the engine is run.

EXAMPLES

A. Platinum Compounds

Platinum hydrochloric acid hexahydrate, $H_2PtCl_6.6H_2O$, is one of the most common and least expensive platinum compounds. However, it has been found that this compound too readily dissolves in gasoline, reaching Pt concentrations exceeding 1.0 g/l, that is by three orders of magnitude higher than the desirable level described above. In order to decrease the solubility of such compounds in gasoline, as expressed above, the protons ($H^+$) in $H_2PtCl_6$ should be replaced by larger cations X, preferably by those of alkali metals, thereby monotomically decreasing the solubility in the order H>Li>Na>K>Rb>Cs.

In an example, briquettes of the compound $X_2PtCl_6$ were formed for each of X=Li, Na, K, Rb and Cs. After a one hour exposure of each different $X_2PtCl_6$ briquette in gasoline, the concentrations of Pt were found to be 200, 12, 2, 0.11 and 0.08 mg/l for X=Li, Na, K, Rb, and Cs, respectively. Although for a longer exposure the Pt concentrations increased, for the K, Rb, and Cs salts the changes were relatively small and were quite acceptable. For example, after 25 hours in gasoline, the platinum concentration $\theta_{Pt}$ was 6, 0.16 and 0.17 mg/l for K, Rb and Cs, respectively.

Therefore, it is K, Rb and Cs salts of $PtCl_6$ which are particularly suited for use in the additives of the invention.

Other platinum compounds, with the oxidation states of Pt(II) and Pt(III) and other inorganic ligands have also been studied. In examples, briquettes of the compounds listed in Table I were formed and exposed to gasoline for 24 hours. The platinum concentration ($\theta_M$) in gasoline is given in Table I. In general, the platinum concentrations for these briquettes are about 0.05 to 0.2 mg/l and are comparable to those obtained by briquettes containing $Rb_2PtCl_6$ or $Cs_2PtCl_6$.

TABLE I

| Metal | Compound | $\theta_M$ (mg/l) |
|---|---|---|
| Pt (II) | cis-$[Pt(NH_3)_2Cl_2]$ | 0.16 |
| Pt (II) | trans-$[Pt(NH_3)_2Cl_2]$ | 0.05 |
| Pt (II) | $[Pt(NH_3)_4]Cl_2.H_2O$ | 0.05 |
| Pt (II) | $Ba[Pt(CN)_4].4H_2O$ | 0.05 |
| Pt (II) | cis-$[Pt((C_6H_5)_3P)_2Cl_2]$ | 0.15 |
| Pt (II) | trans-$[Pt((C_6H_5)_3P)_2I_2]$ | 2.1 |
| Pt (II) | $K_2PtCl_4$ | 0.01 |
| Pt (II) | $PtCl_2$ | 5.3 |
| Pt (III) | $[Pten(NH_3)_2Br](NO_3)_2$* | 0.09 |

*"en" represents ethylene diamine

B. Rhodium Compounds

The preferred (and least expensive) Rh compound for use in catalytic additives of the invention is rhodium trichloride (tetrahydrate) $RhCl_3.4H_2O$. The rhodium concentration in gasoline increases with the length of the exposure and can reach 0.85–2.0 mg/l in the absence of Pt and Re. However, it has been discovered that the concentration of Rh (i.e., the solubility) maintains the desired level in the presence of Pt and Re, namely $\theta_{Rh}$=0.05 to 0.25 mg/l. (see example D).

Other rhodium compounds have also been tested. In particular, briquettes of $[Rh(NH_3)_5Br]Br_2$ and $[RhPy_4Cl_2]Cl.5H_2O$ were formed and exposed to gasoline for 24 hours, wherein Py represents pyridine. The rhodium concentration ($\theta_M$) in gasoline was 0.08 and 0.12 mg/l, respectively.

C. Rhenium Compounds

The preferred (and least expensive) Re compounds are perrhenates $XReO_4$. As with the case for the $X_2PtCl_6$ of Example A, the cation X for the perrhenates was varied to decrease the Re concentration in gasoline, and it was found that the preferred cations are K, Rb, and Cs. For perrhenates having these cations, the concentration of Re is rather insensitive to the time of exposure in gasoline. For example, for $KReO_4$, the Re concentration increases from 150 to 200 mg/l within 1 and 175 hours, respectively.

D. Combinations of Catalytic Metal Compounds of Pt, Rh and Re

It has been found that a desirable strong decrease in the concentration (i.e., solubility) of Rh in gasoline occurs in the presence of Pt and Re compounds. For example, for the combination of $K_2PtCl_6$, $RhCl_3$, and $KReO_4$ in gasoline, the Rh concentration after 165 hours did not exceed 0.16 mg/l which is within the desirable concentration range, as compared to 2.0 mg/l which results with $RhCl_3$ alone. At the same time, the concentrations of Pt and Re are dictated by the nature of the cation X in the compounds $X_2PtCl_6$ and $XReO_4$ as it affects the respective solubilities of these compounds, as discussed above, and are rather insensitive to the presence of other compounds (see Examples B and C). For the briquette combination of $K_2PtCl_6$, $RhCl_3$, and $KReO_4$, metal concentrations after exposure to gasoline over time are given in Table II.

TABLE II

| Exposure (hr) | Pt (mg/l) | Rh (mg/l) | Re (mg/l) |
|---|---|---|---|
| 1 | 2.4 | 0.19 | 178.5 |
| 2 | 2.6 | 0.15 | 157.1 |
| 4 | 2.4 | 0.21 | 157.1 |
| 6 | 4.0 | 0.17 | 214.5 |
| 26 | 6.0 | 0.16 | 192.8 |
| 53 | 4.8 | 0.19 | 178.5 |

E. Palladium and Gold Compounds

Palladium and gold compounds have also been formed into briquettes, and tested upon exposure to gasoline. Table III gives the solubility of several compounds in gasoline after twenty-four hours.

TABLE III

| Metal | Compound | $\theta_M$ (mg/l) |
|---|---|---|
| Pd (II) | $PdCl_2$ | 15.1 |
| Pd (II) | $K_2PdCl_4$ | 10.1 |
| Au (III) | $NH_4AuCl_4$ | 3.6 |
| Au (III) | $[(C_6H_5)_4N]AuCl_4$ | 0.25 |

What is claimed is:

1. A gasoline additive for the three-way catalytic conversion of gasoline combustion engine emission, the additive comprising at least one compound of a three-way metal catalyst selected from the group consisting of noble metals and non-noble metals, wherein each noble metal catalyst is directly soluble in gasoline in a concentration of about 0.01 to about 10 mg/l and each non-noble metal catalyst is directly soluble in gasoline in a concentration of about 10 to about 100 mg/l, the metal catalyst of the additive being capable of being deposited on a surface of a catalytic vessel located downstream of a combustion chamber and of effecting simultaneous oxidation of carbon monoxide and unburned hydrocarbons and reduction of nitrogen oxides, the additive comprising a mixture of $X_2PtCl_6$, $RhCl_3$ and $XReO_4$ where X is selected from the group consisting of potassium, rubidium or cesium.

2. A fuel composition for a gasoline combustion engine comprising a mixture of gasoline and a gasoline additive for the three-way catalytic conversion of gasoline combustion engine emission, the additive comprising at least one compound of a three-way metal catalyst selected from the group consisting of noble metals and non-noble metals, wherein each noble metal catalyst is directly soluble in gasoline in a concentration of about 0.01 to about 10 mg/l and each non-noble metal catalyst is directly soluble in gasoline in a concentration of about 10 to about 100 mg/l, the metal catalyst of the additive being capable of being deposited on a surface of a catalytic vessel located downstream of a combustion chamber and of effecting simultaneous oxidation of carbon monoxide and unburned hydrocarbons and reduction of nitrogen oxides, the additive comprising a mixture of $X_2PtCl_6$, $RhCl_3$ and $XReO_4$ where X is selected from the group consisting of potassium, rubidium or cesium.

3. A gasoline additive for the three-way catalytic conversion of gasoline combustion engine emission, the additive comprising at least one compound of a three-way metal catalyst selected from the group consisting of noble metals and non-noble metals, wherein each noble metal catalyst is directly soluble in gasoline in a concentration of about 0.01 to about 10 mg/l and each non-noble metal catalyst is directly soluble in gasoline in a concentration of about 10 to about 100 mg/l, the metal catalyst of the additive being capable of being deposited on a surface of a catalytic vessel located downstream of a combustion chamber and of effecting simultaneous oxidation of carbon monoxide and unburned hydrocarbons and reduction of nitrogen oxides, the additive comprising a mixture of $X_2PtCl_6$, $RhCl_3$ and $XReO_4$ where X is selected from the group consisting of potassium, rubidium or cesium, wherein the additive is in the form of a briquette.

4. A method for converting emissions from a gasoline internal combustion engine having an exhaust system for receiving and expelling said emissions, comprising the steps of:

forming an additive for the three-way catalytic conversion of gasoline combustion engine emission, the additive comprising at least one compound of a metal catalyst selected from the group consisting of noble metals and non-noble metals capable of effecting said conversion, wherein each noble metal catalyst is directly soluble in gasoline in a concentration of about 0.01 to about 10 mg/l and each non-noble metal catalyst is directly soluble in gasoline in a concentration of about 10 to about 100 mg/l, the additive comprising a mixture of a combination of $X_2PtCl_6$, $RhCl_3$, and $XReO_4$, where X is selected from the group consisting of potassium, rubidium or cesium;

dissolving at least a portion of said additive in gasoline; and feeding the gasoline having said additive dissolved therein to the internal combustion engine;

entraining the metal catalyst in emission fumes from the engine;

depositing the metal catalyst on a surface of a catalytic vessel located downstream of the combustion chamber;

simultaneously oxidizing carbon monoxide and unburned hydrocarbons, and reducing nitrogen oxides in the catalytic vessel by contacting the emissions and the deposited metal.

* * * * *